US005249372A

United States Patent [19]

Wedel

[11] Patent Number: 5,249,372

[45] Date of Patent: Oct. 5, 1993

[54] APPARATUS FOR DRYING A WEB

[75] Inventor: Gregory L. Wedel, Beloit, Wis.

[73] Assignee: Beloit Technologies, Inc., Wilmington, Del.

[21] Appl. No.: 867,722

[22] Filed: Apr. 9, 1992

Related U.S. Application Data

[63] Continuation of Ser. No. 167,672, Feb. 11, 1988, which is a continuation-in-part of Ser. No. 14,569, Feb. 13, 1987, Pat. No. 4,934,067.

[51] Int. Cl.[5] ..... F26B 13/08

[52] U.S. Cl. ..... 34/117; 34/114

[58] Field of Search ..... 34/115, 116, 117, 121, 34/114

[56] References Cited

U.S. PATENT DOCUMENTS

| | | | |
|---|---|---|---|
| 2,537,129 | 1/1951 | Goodwillie . | |
| 2,714,342 | 8/1955 | Beachler . | |
| 2,959,222 | 11/1960 | Hornbostel . | |
| 3,079,699 | 3/1963 | Fry, Jr. . | |
| 3,110,612 | 11/1963 | Gottwald et al. . | |
| 3,263,344 | 8/1966 | Stickle . | |
| 3,314,162 | 4/1967 | Haywood | 34/155 X |
| 3,395,073 | 7/1968 | Davis, Sr. . | |
| 3,868,780 | 4/1975 | Soininen et al. | 34/123 |
| 4,000,035 | 12/1976 | Schiel et al. . | |
| 4,183,148 | 1/1980 | Koski et al. . | |
| 4,202,113 | 5/1980 | Kankaanpaa . | |
| 4,359,827 | 11/1982 | Thomas | 34/116 X |
| 4,359,828 | 11/1982 | Thomas . | |
| 4,441,263 | 4/1984 | Vedenpä . | |
| 4,481,723 | 11/1984 | Vedenpää . | |
| 4,483,083 | 11/1984 | Chance . | |
| 4,510,698 | 4/1985 | Ely . | |
| 4,539,762 | 9/1985 | Eskelinen et al. . | |
| 4,566,944 | 1/1986 | Mauranen et al. . | |
| 4,608,124 | 8/1986 | Mauranen et al. . | |
| 4,625,430 | 12/1986 | Aula et al. . | |
| 4,625,434 | 12/1986 | Karlsson et al. . | |
| 4,677,762 | 7/1987 | Futcher | 34/114 |
| 4,686,778 | 8/1987 | Kotitschke et al. . | |
| 4,758,310 | 7/1988 | Miller | 34/123 X |
| 4,934,067 | 6/1990 | Wedel et al. | 34/117 |
| 4,986,009 | 1/1991 | Haessner et al. . | |
| 5,062,216 | 11/1991 | Hannigan . | |

FOREIGN PATENT DOCUMENTS

| | | |
|---|---|---|
| 2355397 | 6/1974 | Fed. Rep. of Germany . |
| 2813933 | 10/1978 | Fed. Rep. of Germany . |
| 3520070 | 12/1985 | Fed. Rep. of Germany . |
| 3623971 | 1/1986 | Fed. Rep. of Germany . |
| 9001209 | 5/1990 | Fed. Rep. of Germany . |
| 61-217673 | 9/1986 | Japan . |
| 63-89996 | 6/1988 | Japan . |
| 2173832 | 10/1986 | United Kingdom . |
| 8202937 | 9/1982 | World Int. Prop. O. . |
| 8300514 | 2/1983 | World Int. Prop. O. . |
| 8804206 | 6/1988 | World Int. Prop. O. . |

OTHER PUBLICATIONS

"Advances in Dryer Section Runnability" by G. L. Wedel and S. Palazzolo; Tappi Journal, Sep. 1987; pp. 65–69.

"Examining Runnability in the Dryer Section" by I. Binns; Paper; Jul. 13, 1987; pp. 27–28.

"No. 16 Takes Shape"; *Consolidated News*, vol. 29, No. 4, Aug.–Oct. 1991; pp. 8–10.

Wochenblatt fur Papier-fabrikation, Aug. 1986; NR16 pp. 622–628 by J. Linderot.

*Primary Examiner*—Henry A. Bennet

*Attorney, Agent, or Firm*—Dirk J. Veneman; Raymond W. Campbell; David J. Archer

[57] ABSTRACT

A single tier drying section is disclosed for drying a web. The drying section includes a dryer and a felt guided about the dryer such that the web is disposed between the dryer and the felt for drying a first side of the web. A further dryer is disposed downstream relative to the dryer and a further felt is guided about the further dryer such that the web is disposed between the further dryer and the further felt for drying a second side of the web. A dryer transfer mechanism is used for transferring the web from the dryer to the further dryer.

3 Claims, 7 Drawing Sheets

APPARATUS FOR DRYING A WEB

CROSS-REFERENCE TO RELATED APPLICATION

This is a continuation of copending application Ser. No. 07/167,672 filed on Feb. 11, 1988 which is a continuation-in-part of Ser. No. 07/014,569 filed Feb. 13, 1987, now U.S. Pat. No. 4,934, 067. All the disclosure of Ser. No. 014,569 is incorporated herein by reference.

BACKGROUND OF THE INVENTION

1. Field of the Invention

This invention relates to an apparatus for drying a web of paper emerging from a press section of a papermaking machine. More particularly, this invention relates to an apparatus for drying a web in which the web is transferred without open draw between dryer sections, thereby permitting threading of the web without the assistance of threading ropes and the drying of both sides of the web.

2. Information Disclosure Statement

With the ever increasing operational speed of papermaking machines a serious problem has existed in that there is a tendency for the paper web or sheet to flutter as the sheet progresses through the dryer section. Such sheet flutter is particularly evident when the sheet is transferred between succeeding sections of the dryer section as the web is transferred between these adjacent sections in an open draw. Such sheet flutter has been minimized by the use of single felting configurations in which the web and felt run jointly between respective top and bottom cylinders. However, the single felt configuration, although reducing the aforementioned problem of sheet flutter, introduces several disadvantages. Included amongst these disadvantages are, first, the heat transfer from the bottom cylinders is substantially reduced because the wet web is no longer in direct contact with the cylinders, the felt being interposed between the web and the drying surface of the respective cylinder. Second, the web has a tendency to separate from the felt as the web travels towards and around and then away from the bottom cylinder. Third, the initial threading of the web is not particularly easy.

A partial solution to the aforementioned single felt problems ha been provided by the application of the so-called Bel Run dryer section. Bel Run is a registered trademark of Beloit Corporation. With the Bel Run system, the bottom ineffective dryers are replaced by vacuum rolls which positively convey the web from one cylinder to the next. Recent installations of this type of dryer section have shown that the Bel Run concept can be extended to include a large number of dryers without any adverse effect on the web runability. Such runability results because the vacuum rolls are capable of conveying the web along the felt supported spans without the need for sheet tension or section draw points.

With the implementation of the single Bel Run section there exists a tendency to have a generation of stresses which develop in the web as the web dries. Such stresses impart a tendency for the dried paper to curl. Such adverse curling effect can be minimized or eliminated by drying the web from both sides, but two sided drying requires a transfer point in which the web is transferred from one felt to another felt. In the case of the Bel Run configuration, the web must be alternately dried on a top tier dryer section and then on a bottom tier dryer section. A top tier section may be defined as a group of dryers in which the bottom surface of the web contacts the dryers. A bottom tier section conversely and correspondingly may be defined as a group of dryers in which the top surface of the web contacts the dryers.

In order to efficiently transfer the web from one Bel Run section to another, a positive transfer arrangement is required. In the prior art such means for transferring the web from one drying section to the next has required the introduction of an open draw with the associated problems of sheet flutter and the like.

Modern paper drying machines are contemplated in which web speeds of 10,000 or more feet per minute are invisaged. Consequently, the introduction of such open draws would lead to serious problems of sheet flutter and numerous web breakages. The present invention seeks to overcome the aforementioned inadequacies of the prior art apparatus and to provide a drying apparatus which contributes a significant and non-obvious contribution to the paper drying art.

Another object of the present invention is the provision of an apparatus for drying a web of paper emerging from a press section of a papermaking machine such that the web is transferred between a first and a second dryer section means without open draw, thereby permitting both threading of the web without the assistance of threading ropes and the drying of the web on both sides thereof.

Another object of the present invention is the provision of an apparatus for drying a web of paper which completely eliminates the need of open draws.

Another object of the present invention is the provision of an apparatus for drying a web of paper in which open draws for the sheet or web is eliminated.

Another object of the present invention is the provision of an apparatus for drying a web of paper in which blow boxes would be redundant.

Another object of the present invention is the provision of an apparatus for drying a web of paper in which ventilation of the pockets defined by the cylinders and the vacuum rolls is improved, thereby improving the drying rate of the web.

Another object of the present invention is the provision of an apparatus for drying a web of paper in which gear case leaks are inhibited and removal of broke is facilitated.

Another object of the present invention is the provision of an apparatus for drying a web of paper in which fewer steamfits are required and none of the dryers are redundant, thereby reducing the blow through rate.

Another object of the present invention is the provision of an apparatus for drying a web of paper in which the frame is symmetrical and in which the base frame is subjected to equal loading forces, thereby resulting in sturdy low-profile frame which reduces vibration and its attendant noise level.

Another object of the present invention is the provision of an apparatus for drying a web of paper in which the power required to drive the cylinders is reduced and due to the layout and configuration of the dryers, such arrangement lends itself to the provision of a low-profile hood.

Another object of the present invention is the provision of an apparatus for drying a web of paper in which runability of the drying apparatus is increased and in which doctors can be applied to each dryer.

Another object of the present invention is the provision of an apparatus for drying a web of paper which permits automatic threading of a tail and subsequent web therethrough.

Another object of the present invention is the provision of an apparatus for drying a web in which open access to the dryers and vacuum rolls is provided and a supply of air can be fed uniformly through each of the vacuum rolls.

Another object of the present invention is the provision of an apparatus for drying a web of paper in which hoods are provided over and adjacent the vacuum rolls for handling the humid exhaust and possibly eliminating the need for large scale exhaust hood construction.

Another object of the present invention is the provision of an apparatus for drying a web of paper in which such vacuum roll hoods can be provided for profiling the web by removing exhaust air from selected transfer sections of these hoods.

Another object of the present invention is the provision of an apparatus for drying a web ranging from tissue to fine paper.

Another object of the present invention is the provision of an apparatus for drying a web of paper in which the felt wrap is increased relative to the felt wrap of a two felt type drying section, particularly by decreasing the space between adjacent dryers.

Another object of the present invention is the provision of an apparatus for drying a web of paper in which the humidity is decreased by eliminating the closed pockets associated with a typical two felt type drying section.

Another object of the present invention is the provision of an apparatus for drying a web of paper in which the apparatus is no longer than a conventional dryer section but requires less equipment.

Another object of the present invention is the provision of an apparatus for drying a web of paper in which runnability is improved by eliminating open draws.

Another object of the present invention is the provision of an apparatus for drying a web of paper in which the felt supported draw is reduced to a minimum.

Another object of the present invention is the provision of an apparatus for drying a web of paper in which sheet control is provided by the direct application of vacuum.

Another object of the present invention is the provision of an apparatus for drying a web of paper in which there is no need for residual sheet tension to hold the sheet against the felt since the sheet is entirely supported by vacuum as it wraps the transfer roll. In a conventional Uno-Run dryer section, a draw is required in order to induce a tension in the sheet to hold the sheet as it wraps the bottom dryer. Although blow boxes can be used to prevent the sheet from leaving the felt, the vacuum produced by these boxes is quite low—in the order of 0.05 to 0.1 inches wc (water column). Furthermore, the vacuum does not extend around the bottom dryer and it is generally not sufficient to hold the sheet against centrifugal forces and residual sheet tension is required to hold the sheet against the felt.

In the arrangement according to the present invention, the transfer roll vacuum is not so limited and typically, 4 inches wc is applied to the web which is more than four times the level needed for sheet support.

Another object of the present invention which is a less obvious factor relative to the runnability of the dryer section is the uniformity of dryer surface speeds. Such uniformity is obtained because the dryers are driven by the felt instead of by a gear train. Dryers which are geared together are forced to run at equal rotational speeds. In the case of dryers which have slightly different diameters, perhaps due to manufacturing tolerances or differences in steam pressure, such differences result in unequal dryer surface speeds. These unequal surface speeds not only increase the drive load but also cause problems with sheet runnability.

Another object of the present invention is the provision of an apparatus for drying a web of paper in which threading of the apparatus is simplified.

More specifically, in a conventional Uno-Run system, the tail tends to separate from the felt on the bottom dryers and wander in the cross machine direction as it moves down the machine. In the dryer section according to the present invention, the vacuum transfer rolls are equipped with internal dampers for concentrating the vacuum in front side threading chambers. When these dampers are closed, the vacuum in the threading chambers is increased from 4 inches wc to 10–12 inches wc. Such vacuum holds the tail tightly to the felt and prevents the tail from wandering and stabilizes the entire threading operation.

Additionally, when the apparatus according to the present invention is extended through the entire dryer section, the tail can be threaded without the use of ropes. Special air nozzles are located near the edges of each dryer to insure that the tail follows the felt and is transferred by the vacuum rolls. These air nozzles eliminate the need for threading ropes, threading equipment and maintenance. Furthermore, the aforementioned threading arrangement helps to insure safe operation of the apparatus.

Also, when the ropes are removed, a wider felt can be used which tends to further stabilize the edges of the sheet on the felt.

With the open symmetrical framing according to the present invention, broke removal, dryer access, and dryer visibility are greatly improved. Additionally, although not a requirement of the present invention, each of the dryers can be easily fitted with a doctor, such doctors being unloaded automatically with air cylinders if required.

The apparatus according to the present invention permits a significant reduction in the amount of paper machinery which is required to meet the design production. In addition to reducing the number of dryers, felt rolls and guides, there is also a corresponding reduction in the number of steamfits, the elimination of blow boxes and pocket ventilation ducts. Also, the present invention enables simplification of the dryer framing.

With the application of the "Silent Drive" dryer system (Silent Drive is a registered trademark of Beloit Corporation) and additionally with the low profile afforded by the framing layout of the present invention, dryer section noise and vibration will be reduced to a minimum. Furthermore, smaller drive motors can be installed due to the fact that the section inertia is reduced in view of the elimination of the bottom dryers utilized in a typical Uno-Run system. Additionally, the dryer hood can have a low profile construction, and hood door lifts can be installed on the back as well as the front of the machine.

Another object of the present invention is the provision of an apparatus for drying a web of paper in which the energy efficiency of the apparatus is improved.

More specifically, the dryer section of the present invention provides improved energy efficiency in the following three areas. First, the drive load is reduced by having fewer dryers and less steamfit drag. Second, the amount of blowthrough steam is reduced by minimizing the number of dryers. Third, the large blowthrough quantities associated with the bottom dryers of conventional Uno-Run type sections are entirely eliminated.

Another object of the present invention is the provision of an apparatus for drying a web of paper in which the quality of the sheet is improved.

More specifically, the dryer section according to the present invention has the capability of affecting the sheet properties as follows. First, the tensile strength and stretch of the web in the machine direction is improved. Second, the tensile strength and stretch of the web in the cross machine direction is improved. Third, the tendency for the sheet to curl is reduced and fourth, the tendency to generate edge cockles is reduced.

Once the sheet leaves the press section, the machine direction tensile and stretch are affected primarily by the press section draw and somewhat less by the draw between dryer sections. In conventional drying sections, these dryer draws are usually set as low as possible but the minimum draw is dictated by runnability and sheet control. However, in the drying section according to the present invention, there is no minimum draw requirement for runnability. Nevertheless, the machine direction properties can still be affected in the usual way by pulling a draw between sections if such is deemed desirable.

In a somewhat similar manner, the cross machine direction tensile and stretch are affected by the cross machine direction sheet restraint. In an open draw, there is no restraint, so the sheet freely shrinks (although this shrinkage is greatest at the edges). In operation of a typical Uno-Run type drying section, there is a degree of web restraint as evidenced by the increase in trim and the decrease in edge cockles.

In the drying section according to the present invention, the sheet restraint is more positive than that provided by a typical Uno-Run system and this further reduces any tendency for edge cockles to develop. With the improved restraint provided by the present invention, a slight increase in cross machine direction tensile and a decrease in cross machine direction stretch is evident. The decrease in cross machine direction stretch is most pronounced at the edges where the sheet normally has the least restraint. Accordingly, the net effect according to the present invention, will be a sheet with more uniform properties in the cross machine direction.

The propensity to curl is caused by three factors as follows. First, fiber orientation, second fines and filler (bonding) distribution, and third, residual fiberstress.

The dryer section affects only the fiber stress. Curl is normally controlled by adjusting the drying from each side of the sheet by separate control of the top and bottom dryer steam pressures.

Accordingly, in the drying section according to the present invention, such control is provided by adjusting the steam pressures in subsequent sections.

Another particularly important object of the present invention is the provision of an apparatus for drying fine paper grades where directionality is important. More particularly, restrained drying of the web is an important feature of the present invention in that it will not permit the edges of the sheet to shrink more than the center portion of the sheet. The key to restraining the sheet while it is not held between the felt and the dryer drum is the vacuum in the transfer, or turning roll, below adjacent drums. The sheet may be restrained as stated hereinbefore by application of a vacuum within the range 1–10 inches wc and preferably approximately 4 inches wc.

Other objects and advantages of the present invention will be apparent to those skilled in the art by a consideration of the following detailed description taken in conjunction with the annexed drawings.

Although the detailed description and annexed drawings describe a preferred embodiment of the present invention, it should be appreciated by those skilled in the art that many variations and modifications of the present invention fall within the spirit and scope of the present invention as defined by the appended claims.

SUMMARY OF THE INVENTION

The present invention relates to a single tier drying section for drying a web. The drying section includes a dryer and a felt guided about the dryer such that the web is disposed between the dryer and the felt for drying a first side of the web. A further dryer is disposed downstream relative to the dryer and a further felt is guided about the further dryer such that the web is disposed between the further dryer and the further felt for drying a second side of the web. A transfer means transfers the web from the dryer to the further dryer.

More particularly, the dryer transfer means transfers the web without open draw from the dryer to the further dryer.

Additionally, the dryer transfer means includes a joint run of the felt and the further felt such that the web is disposed between the felt and the further felt during passage through the joint run.

In one embodiment of the present invention, the transfer means further includes vacuum means disposed downstream relative to the joint run for positively maintaining the web in close conformity with the further felt when the felt and further felt diverge relative to each other downstream relative to the joint run.

More specifically, the vacuum means is a vacuum roll.

Preferably, the single tier drying section extends from a press section to a calender section and includes a multiplicity of single tier subsections and the dryer transfer means includes a plurality of transfer mechanisms with each transfer mechanism being disposed between adjacent subsections such that as the web progresses through subsequent subsections, alternate sides of the web are dried.

The arrangement is such that alternate sides of the web are sequentially dried as the web progresses through the subsections and each of the subsections are disposed at different heights relative to each other with preferably every other subsection disposed at the same height relative to each other.

The dryer transfer means also includes air nozzle means for assisting guidance of a tail of the web from the dryer to the further dryer.

In an alternate embodiment of the present invention, the dryer transfer means includes means for transferring the web with open draw from the dryer to the further dryer.

Additionally, the present invention relates to an apparatus and method for drying a web of paper emerging from the press section of a papermaking machine. The apparatus includes a first dryer section means for initiating the drying of the first side of the web. The first transfer means transfers the web from the press section to the first dryer section means. A second dryer section means is disposed downstream relative to the first dryer section means for initiating the drying of the second side of the web. The second side of the web is opposite to the first side of the web. A first dryer transfer means transfers the web without open draw between the first and the second dryer section means such that the first dryer transfer means permits both threading of the web without the assistance of threading ropes and the drying of both sides of the web.

More particularly, the first dryer section means also includes a first dryer section for initiating the drying of the first side of the web and a second section disposed downstream relative to the first dryer section for continuing the drying of the first side of the web. A second dryer transfer means transfers the web without open draw between the first and the second dryer sections.

The first dryer section includes a first plurality of dryers and a first plurality of vacuum rolls with each of the vacuum rolls being disposed adjacent to a corresponding dryer of the first plurality of dryers such that the web extends alternately past each vacuum roll and a dryer in serpentine configuration. The first felt extends around the first plurality of dryers and the first plurality of vacuum rolls in close conformity with the web. The second dryer includes a second plurality of dryers and a second plurality of vacuum rolls with each vacuum roll of the second plurality of vacuum rolls being disposed adjacent to a corresponding dryer of the second plurality of dryers, such that the web extends alternately past each vacuum roll and dryer in serpentine configuration. A second felt extends around the second plurality of dryers and vacuum rolls respectively such that the second felt is disposed in close conformity with the web. The second felt and an unfelted portion of a downstream dryer of the first dryers defines a first pick-up section for transferring the web from the unfelted portion onto the second felt so that the web is transferred without draw from the first dryer section to the second dryer section.

Each of the vacuum rolls of the first and the second dryer sections are disposed in spaced close proximity to their adjacent corresponding dryers such that the felt draw between each of the vacuum rolls and the corresponding dryer is minimal, thereby inhibiting any tendency of the web to flutter relative to the supporting felts.

The apparatus also includes a base frame for rotatably supporting the first and the second plurality of dryers such that the axis of the first and the second plurality of dryers are disposed in the first plane. The frame also rotatably supports the first and the second plurality of vacuum rolls such that the axis of the first and second plurality of vacuum rolls disposed in a second plane with the first plane being disposed by the second plane.

An upstream vacuum roll of the second plurality of vacuum rolls is disposed in close proximity to the unfelted portion of the downstream dryer of the first dryer section. A first felt roll is rotatably supported by the base frame for guiding the second felt past and in conformity with the unfelted portion of the downstream dryer and thereafter around the upstream vacuum roll of the second dryer section such that the web is transferred from the unfelted portion to the second felt without open draw.

The first transfer means for transferring the web from the press section to the first dryer section means also includes a lead in roll which is disposed in spaced close proximity relative to the press section. The first felt extends around the lead in roll for transferring the web from the press section to the first dryer section means. A guide roll is disposed between the lead in roll and the first dryer section means for assisting the transfer of the web from the press section towards the first dryer section means. A transfer felt extends around the guide roll such that the transfer felt and the first felt defined therebetween a transfer section for transferring the web from the press section towards the first dryer section means.

The first transfer means also includes an upstream vacuum roll of the first dryer section means. This upstream vacuum roll cooperates with the first felt and the transfer felt such that the transfer section extends from the guide roll to the upstream vacuum roll so that the web emerging from the transfer section is guided around the upstream vacuum roll into the first dryer section means.

The second dryer section means also includes a third plurality of dryers with each of the dryers of this third plurality of dryers being disposed downstream relative to the first dryer section means. A third plurality of vacuum rolls are each disposed in spaced close proximity relative to a corresponding dryer of the third plurality of dryers such that the web extends alternately past each vacuum roll and dryer of the second dryer section means in serpentine configuration.

The third plurality of dryers and vacuum rolls are rotatably secured to the base frame such that the third plurality of dryers are disposed in a third plane and the third plurality of vacuum rolls disposed in a fourth plane with the fourth plane being disposed above the third plane. A third felt extends past the third plurality of dryers and vacuum rolls such that the third felt supports the web through the second dryer section means with the second side of the web being urged by the third felt into close conformity with each dryer of the third plurality of dryers.

The first dryer transfer means also includes a downstream vacuum roll of the first dryer section means. A downstream felt roll of the first dryer section means, a second felt of the first dryer section means extends between the downstream vacuum roll and the downstream felt roll with the second felt supporting the web such that the web is conveyed and disposed between the second felt and the second dryer section means.

The first dryer transfer means also includes an upstream vacuum roll of the second dryer section means and an upstream felt roll. A third felt extends between the upstream felt roll and the upstream vacuum roll of the second dryer section means such that the third felt and the second felt define therebetween a first dryer transfer means section for transferring the web without open draw from the second to the third felt.

Subsequent dryer section means are provided such that the first, second, third and fourth dryer transfer means permit the transfer of the web between their respective dryer sections without open draw with an alternate reversing of the web such that the first and second side of the web are alternately dried as the web extends through the apparatus and past succeeding dryer section means.

The invention also includes a method of drying a web of paper emerging from a press section of a papermaking machine, the method comprising the steps of transferring the web from the press section to a first dryer section of the apparatus, initiating the drying of a first side of the web during passage of the web through the first dryer and transferring the web without open draw between the first dryer section and a downstream second dryer section, the web transfer being such that the web is reversed so that drying of a second side of the web is initiated during passage of the web through the second dryer section, the second side of the web being opposite to the first side of the web.

The method also includes the step of transferring the web without open draw between subsequent dryer sections such that the first and second side of the web are alternately exposed to the drying effect of the subsequent dryer sections in sequence.

Although the following detailed description exemplifies a particular embodiment of the present invention, it should be understood by those skilled in the art that the present invention is not limited to such an arrangement. Rather the present invention as defined by the appending claims invisages a multitude of variations thereof, including a single felt extending around the dryers of the first and second dryer sections rather than using a first and second felt as shown in the drawings. Furthermore, although the present invention shows the drying apparatus with a first, second, third, fourth and fifth dryer section means, the present invention is not limited to such an arrangement and the various dryer section means may be staggered and disposed in any configuration thereof in order to reduce the overall length of the drying section without the introduction of an open draw.

DETAILED DESCRIPTIONS OF THE PREFERRED EMBODIMENT

Figure 1:
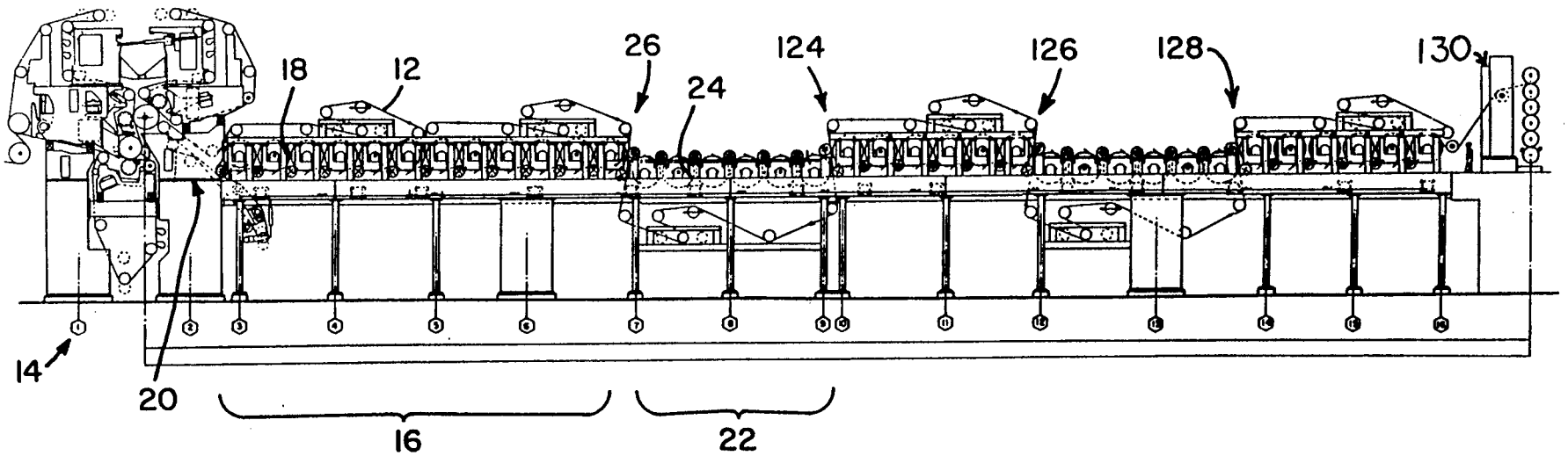
FIG. 1 is a side elevational view of the apparatus according to the present invention showing the press section, the first transfer means, the first dryer section means, the second dryer section means, and the first dryer transfer means, according to the present invention.

FIG. 1 is a side elevational view showing the apparatus generally designated 10 for drying a web 12 of paper emerging from a press section, generally designated 14 of a paper making machine. The apparatus 10 includes a first dryer section means, generally designated 16 for initiating the drying of a first side 18 of the web 12.

A first transfer means generally designated 20 transfers the web 12 from the press section 14 to the first dryer section means 16.

A second dryer section means generally designated 22 is disposed downstream relative to the first dryer section means 16. This second dryer section means 22 initiates the drying of a second side 24 of the web 12. The second side 24 of the web 12 being opposite to the first side 18 thereof.

A first dryer transfer means generally designated 25 transfers the web 12 without open draw between the first and second dryer section means 16 and 22 respectively. The first dryer transfer means 25 permits both threading of the web 12 without the assistance of threading ropes and the drying of both sides 18 and 24 of the web 12.

Figure 2:
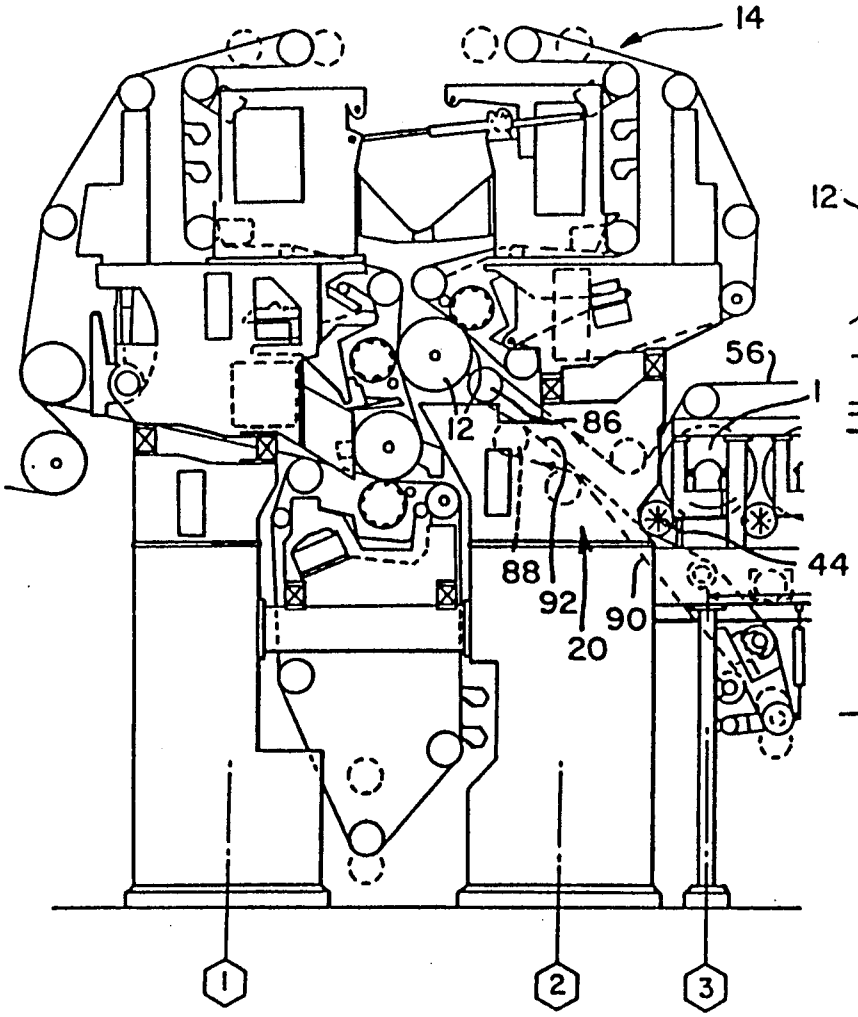
FIG. 2 is an enlarged fragmentary view of FIG. 1 showing the press section, and more particularly, the first transfer means for transferring the web from the press section to the first dryer section.

FIG. 2 shows in more detail the first transfer means 20 and will be described in more detail hereinafter.

Figure 3:
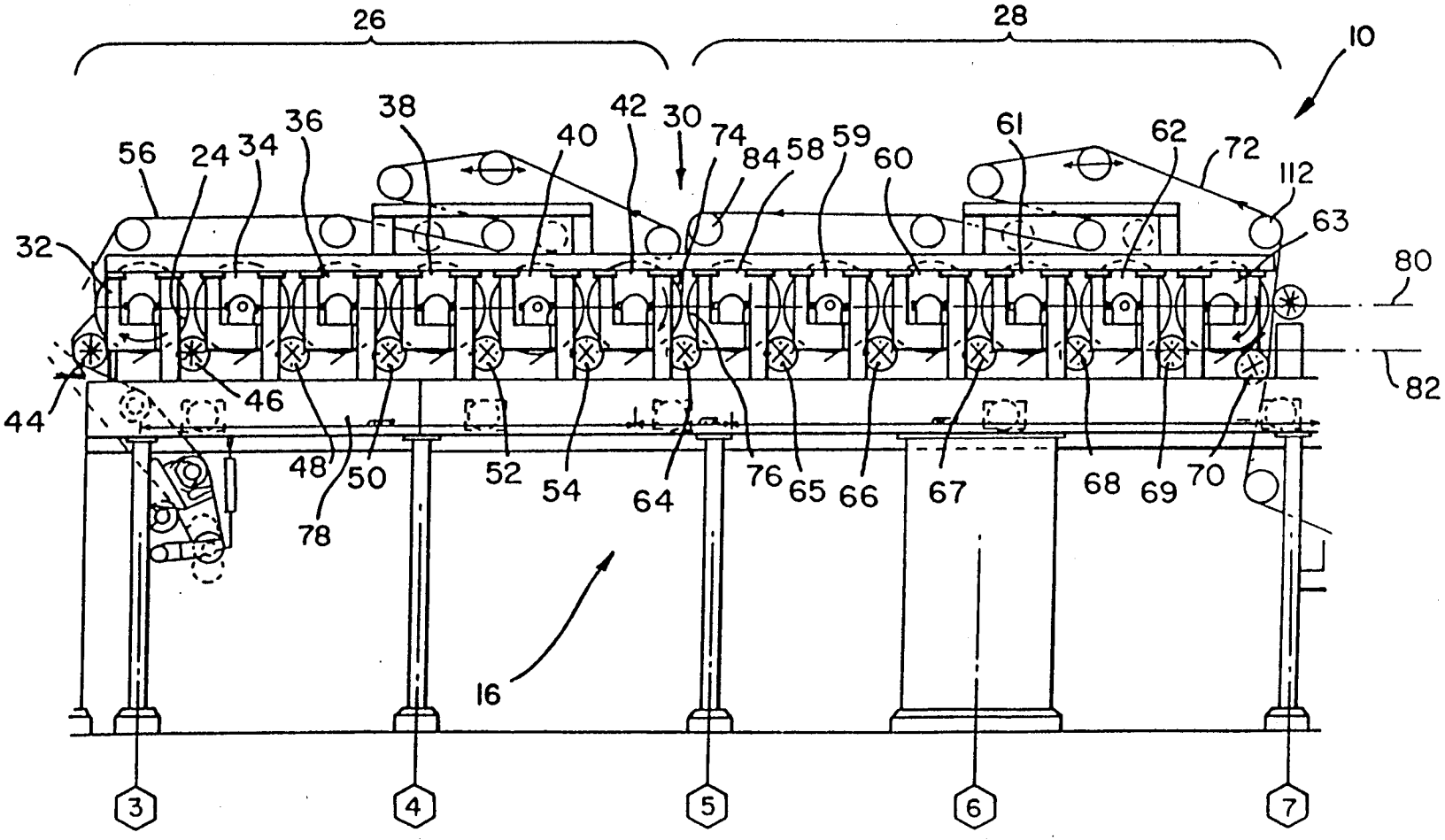
FIG. 3 is an enlarged fragmentary view of FIG. 1 showing the first dryer section means, including the first dryer section and the second dryer section.

FIG. 3 shows in detail the first dryer section means 16. This first dryer section means 16 includes a first dryer section generally designated 26 for initiating the drying of the first side 18 of the web 12. A second dryer section generally designated 28 is disposed downstream relative to the first dryer section 26 for continuing the drying of the first side 18 of the web 12. A second dryer transfer means generally designated 30 transfers the web 12 without open draw between the first and the second dryer sections 26 and 28 respectively.

More particularly, with reference to FIG. 3, the first dryer section also includes a first plurality of dryers 32, 34, 36, 38, 40 and 42 respectively. The first dryer section 26 also includes a first plurality of vacuum rolls 44, 46, 48, 50, 52 and 54 respectively. The first plurality of vacuum rolls 44 to 54 are disposed adjacent to a corresponding dryer of the first plurality of dryers 32 to 42 such that the web 12 extends alternately past each vacuum roll 44 to 54 and dryer 32 to 42 in serpentine configuration.

A first felt 56 extends around the first plurality of dryers 32 to 42 and the first plurality of vacuum rolls 44 to 54 in close conformity with the web 12.

The second dryer section 28 also includes a second plurality of dryers 58, 59, 60, 61, 62 and 63.

The second dryer section 28 also includes a second plurality of vacuum rolls 64, 65, 66, 67, 68, 69 and 70. The vacuum rolls 64 to 70 are disposed adjacent to a corresponding dryer of the second plurality of dryers 58 to 63 such that the web 12 extends alternately past each vacuum roll 64 to 70 and dryer 58 to 63 in serpentine configuration.

A second felt 72 extends around the second plurality of dryers 58 to 63 and the vacuum rolls 64 to 70 respectively such that the second felt 72 is disposed in close conformity with the web 12.

The second felt 72 and an unfelted portion 74 of the downstream dryer 42 of said first dryers 32 to 42 defines a first pick-up section generally designated 76 for transferring the web 12 from the unfelted portion 74 onto the second felt 72 so that the web 12 is transferred without draw from the first dryer section 26 to the second dryer section 28.

Each of the vacuum rolls of the first and the second dryer sections 26 to 28 are disposed in spaced close proximity to their adjacent corresponding dryers such that the felt draw between each of the vacuum rolls and their corresponding dryers is minimal, thereby inhibiting any tendency of the web to flutter relative to the supporting felts 56 and 72 respectively.

As shown in FIG. 3 the apparatus 10 also includes a base frame 78 for rotatably supporting both the first and the second plurality of dryers such that the axis of the first and second plurality of dryers are disposed in a first plane 80 as shown in FIG. 3.

Additionally, the frame 78 rotatably supports the first and second plurality of vacuum rolls such that the axis of the first and the second plurality of vacuum rolls are disposed in a second plane 82 shown in FIG. 3. The first plane 80 is disposed above the second plane 82 as shown in FIG. 3.

As shown in FIG. 3 the apparatus 10 includes an upstream vacuum roll 64 of the second plurality of vacuum rolls and this vacuum roll 64 is disposed in spaced close proximity to the unfelted portion 74 of the downstream dryer 42 of the first dryer section 26.

A first felt roll 84 is rotatably supported by the base frame 78 for guiding the second felt 72 past and in conformity with the unfelted portion 74 of the downstream dryer 42 and thereafter around the upstream vacuum roll 64 of the second dryer section 28 such that the web 12 is transferred from the unfelted portion 74 to the second felt 72 without open draw.

As shown in FIG. 2 referred to hereinbefore the apparatus 10 includes a first transfer means 20 for transferring the web 12 from the press section 14 to the first dryer section means 16. This first transfer means 20 further includes a lead in roll 86 which is disposed in spaced close proximity relative to the press section 14. The first felt 56 extends around this lead in roll 86 for transferring the web 12 from the press section 14 to the first dryer section means 16.

A guide roll 88 is disposed between the lead in roll 86 and the first dryer section means 16 for assisting the transfer of the web 12 from the press section 14 towards the first dryer section means 16.

A transfer felt 90 extends around the guide roll 88 such that the transfer felt 90 and the first felt 56 define therebetween a transfer section 92 for transferring the web 12 from the press section 14 toward the first ryer section means 16.

With further reference to FIG. 2, the first transfer means 20 further includes an upstream vacuum roll 44 of said first dryer section means 16. The upstream vacuum roll 44 cooperates with the first felt 56 and the transfer felt 90 such that the transfer section 92 extends from the guide roll 88 to the upstream vacuum roll 44 so that the web 12 emerging from the transfer section 92 is guided around the upstream vacuum roll 44 into the first dryer section means 16.

Figure 4:
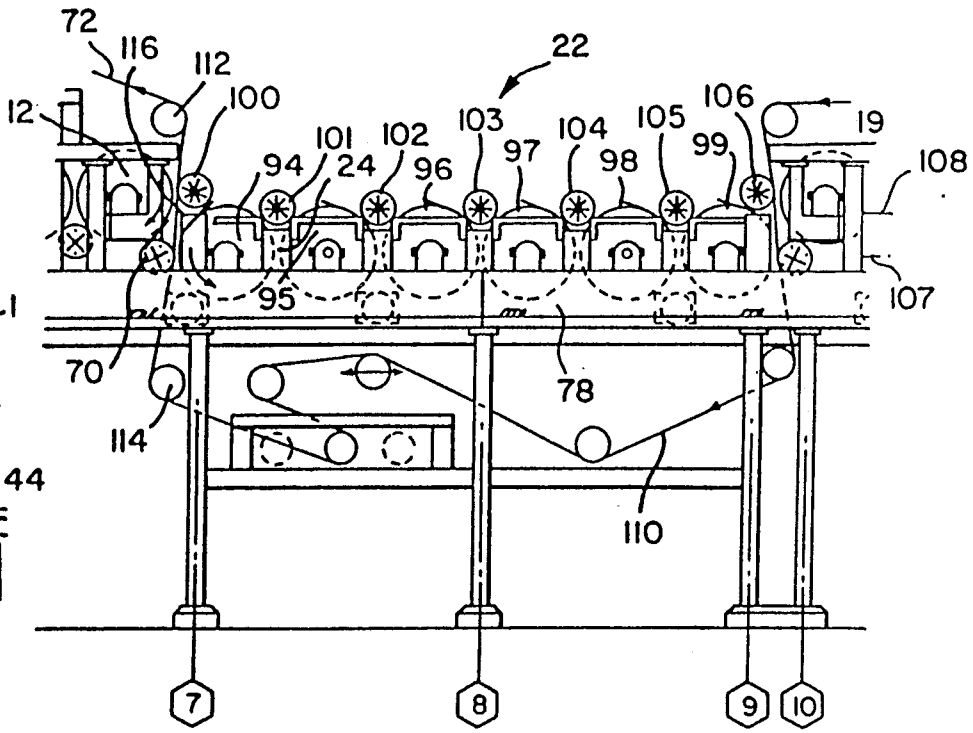
FIG. 4 is an enlarged fragmentary view of FIG. 1 showing the second dryer section means.

With reference to FIG. 4 the second dryer section means 22 also includes a third plurality of dryers 94, 95, 96, 97, 98 and 99. The third plurality of dryers being disposed downstream relative to the first dryer section means 16.

A third plurality of vacuum rolls 100, 101, 102, 103, 104, 105 and 106 are disposed in spaced close proximity relative to a corresponding dryer of the third plurality of dryers such that the web 12 extends alternately past each vacuum roll and dryer of the second dryer section means 22 in serpentine configuration.

As shown in FIG. 4 the base frame 78 rotatably supports each of the dryers of the third plurality of dryers such that the axis of the dryers are disposed in the third plane 107.

The base frame 78 also rotatably supports each of the vacuum rolls such that the axis of each of the vacuum rolls of the third plurality of vacuum rolls are disposed in a fourth plane 108 with the fourth plane being disposed above the third plane.

A third felt 110 extends past the third plurality of dryers and vacuum rolls such that the third felt supports the web through the second dryer section means 22 with the second side of the web being urged by the third felt 110 into close conformity with each dryer of the third plurality of dryers.

As shown in FIG. 4 the first dryer transfer means includes a downstream vacuum roll 70 of the first dryer section means 16 and a downstream felt roll 112 of the first dryer section 16.

The second felt 72 of the first dryer section means 16 extends between the downstream vacuum roll 70 and the downstream felt roll 112. The second felt 72 supports the web 12 that the web is conveyed and disposed between the second felt 72 and the second dryer section means 22.

The first dryer transfer means also includes an upstream vacuum roll 100 and and upstream felt roll 114. A third felt 110 extends between the upstream felt roll 114 and the upstream vacuum roll 100 of the second dryer section means 22 such that the third felt 110 and the second felt 72 define therebetween a first dryer transfer means section 116 for transferring the web without open draw from the second to the third felts 72 and 110 respectively.

The third felt 110 presses against the web such that the second side of the web is pressed into close conformity with each dryer of the third plurality of dryers such that the second side of the web is dried.

Figure 6:
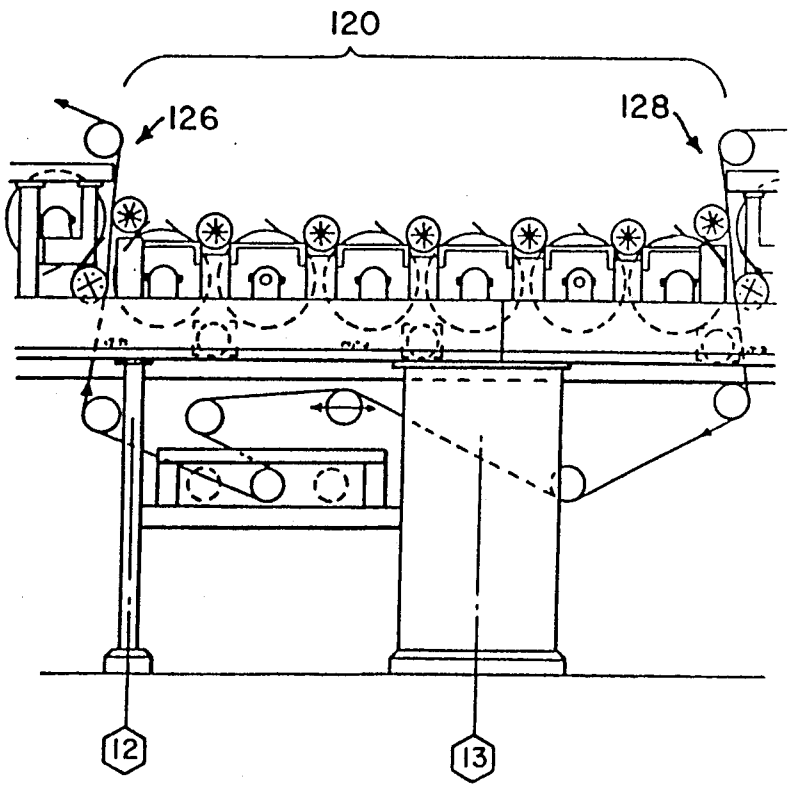
FIG. 6 is an enlarged fragmentary view of FIG. 1 showing the fourth dryer section means.
Figure 5:
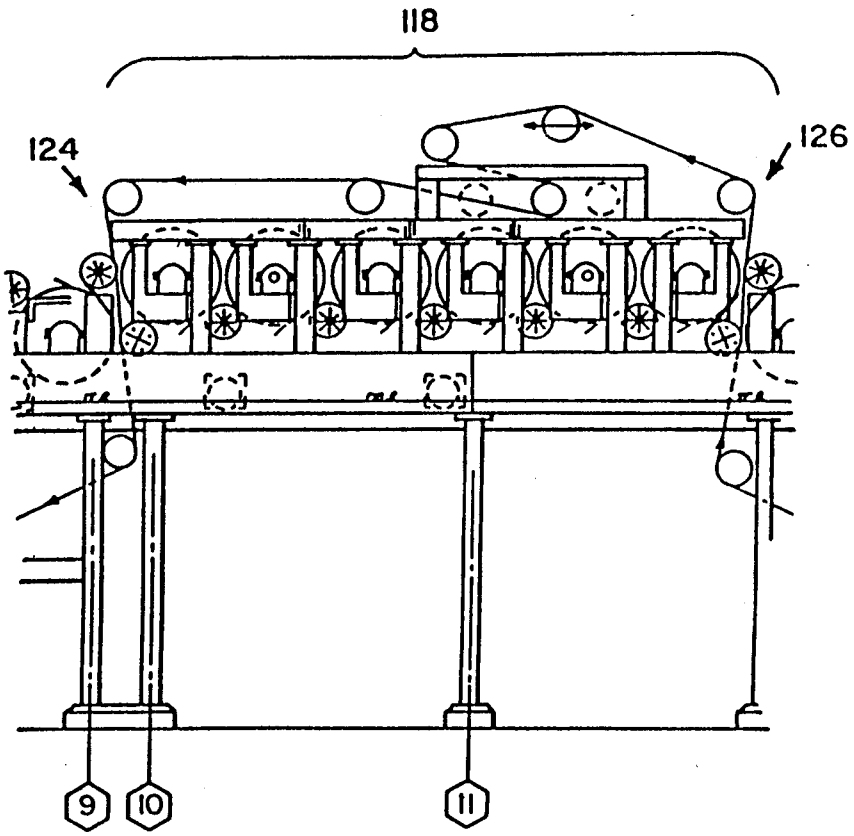
FIG. 5 is an enlarged fragmentary view of the third dryer section means.
Figure 7:
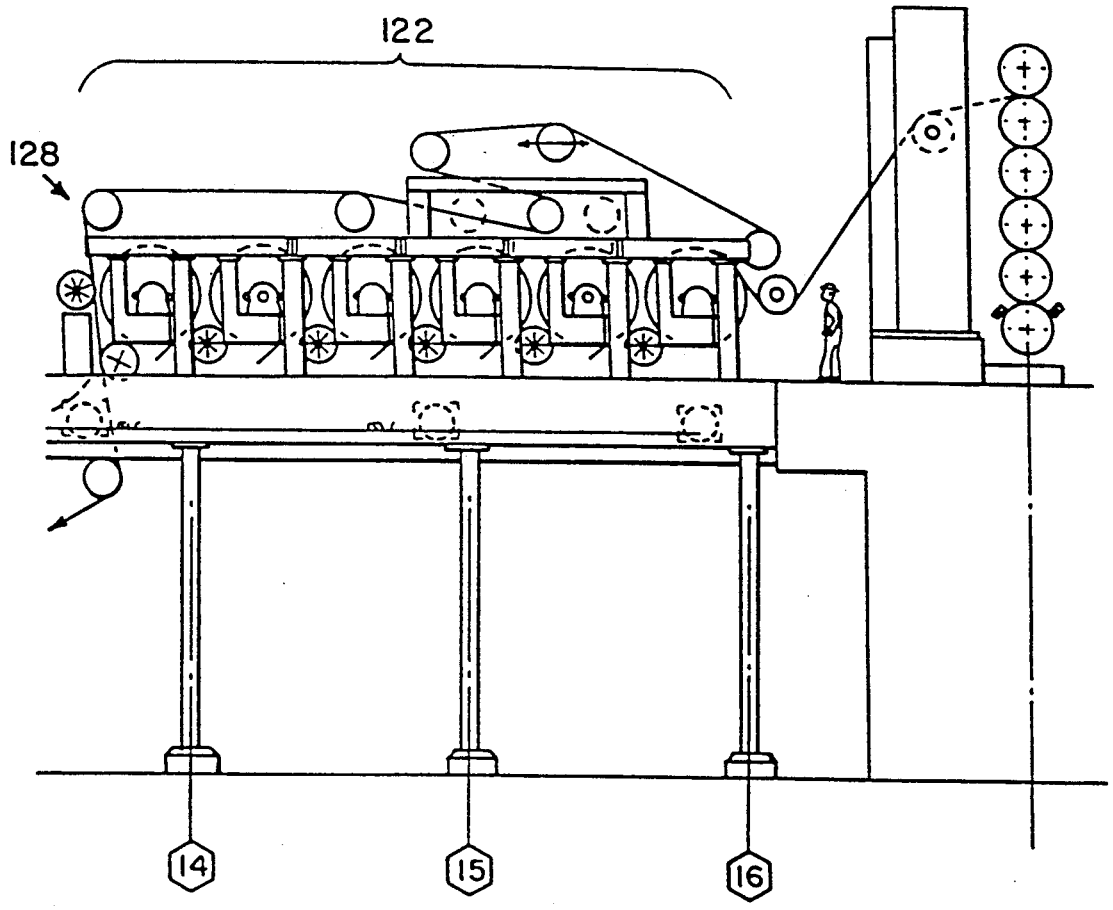
FIG. 7 is an enlarged fragmentary view of FIG. 1 showing the fifth dryer section means.

FIGS. 5, 6, and 7 respectively show third, fourth, and fifth dryer section means respectively and second, third and fourth dryer transfer means 118, 120 and 122 respectively for transferring and reversing the web as the web progresses through the drying apparatus. The first, second, third and fourth dryer transfer means 26, 124, 126 and 128 permit the transfer of the web between the respective dryer sections 16, 22, 118, 120 and 122 without open draw and with an alternate reversing of the web such that the first and second sides of the web are alternately dried as the web extends through the apparatus and past succeeding dryers section means.

Figure 8:
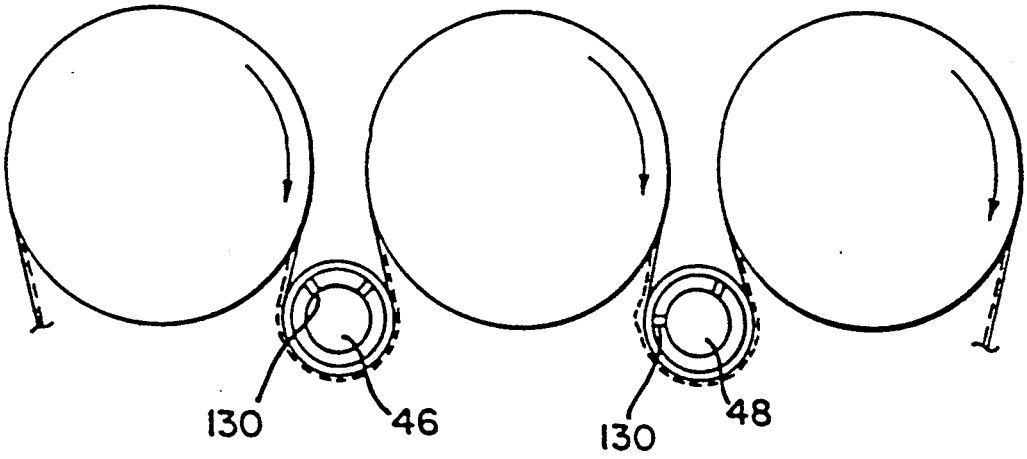
FIG. 8 is a side elevational view of the present invention showing two of the vacuum rolls.

FIG. 8 shows the details of two of the vacuum rolls 46, 48 in which pressure seals 130 may be moved from the position shown with reference to the roll 46 to that shown relative to roll 48 for counteracting the tendency of the web to part from the felt.

In one embodiment of the present invention as shown in FIGS. 1-9, a single tier drying section 16 for drying a web comprises in combination, a dryer 63 and a felt 72 guided about the dryer 63 such that the web is disposed between the dryer 63 and the felt 72 for drying a first side of the web. A further dryer 94 is disposed downstream relative to the dryer 63 and a further felt 110 is guided about the further dryer 94 such that the web is disposed between the further dryer 94 and the further felt 110 for drying a second side of the web. A dryer transfer means 116 transfers the web without open draw from the dryer 63 to the further dryer 94.

More particularly, the dryer transfer means 116 transfers the web without open draw from the dryer 63 to the further dryer 94.

Additionally, the dryer transfer means 116 includes a joint run of the felt 72 and the further felt 110 such that the web is disposed between the felt 72 and the further felt 110 during passage through the joint run.

Also, the dryer transfer means 116 further includes vacuum means 100 disposed downstream relative to the joint run for positively maintaining the web in close conformity with the further felt 110 when the felt 72 and further felt 110 diverge relative to each other downstream relative to the joint run.

In a specific embodiment of the present invention, the vacuum means 100 is a vacuum roll.

Preferably, the single tier drying section 16 extends from a press section 14 to a calender section 130 or to a size press (not shown) or throughout the entire dryer section. The single tier drying section 16 includes a multiplicity of single tier subsections 16,22,118,120 and 122 and the dryer transfer means 116 includes a plurality of transfer mechanisms 26,124,126 and 128 each transfer mechanism 26,124,126 and 128 being disposed between adjacent subsections such that as the web progresses through subsequent subsections 16,124,126 and 128 alternate sides of the web are dried.

The arrangement is such that alternate sides 18 and 24 of the web are sequentially dried as the web progresses through the subsections 16,22,118,120 and 122.

Additionally, the subsections 16,22,118,120 and 122 are disposed at different heights relative to each other and preferably every other subsection 16,118 and 122 and 22 and 120 are disposed at the same height relative to each other.

Figure 9:
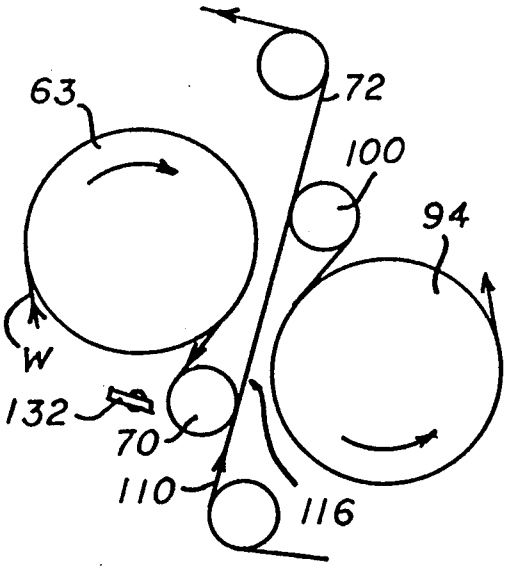
FIG. 9 is a side elevational view of one embodiment of the present invention showing the air nozzle means for assisting guidance of the tail of the web from the dryer to the further dryer.

As shown particularly in FIG. 9, the dryer transfer means 116 also includes air nozzle means 132 for assisting guidance of the web from the dryer 63 to the further dryer 94.

Figure 10:
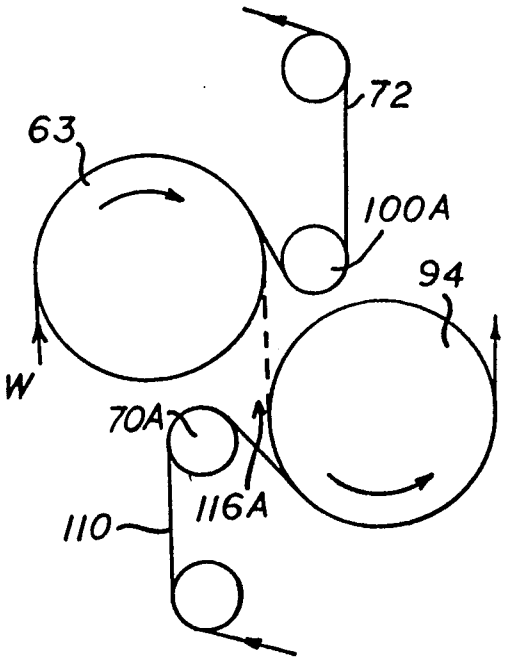
FIG. 10 is a side elevational view of a further embodiment of the present invention showing an open draw transfer.

In an alternative embodiment shown in FIG. 10, the transfer means 116A also includes means 100A and 70A for transferring the web with open draw from the dryer 63A to a further dryer 94A.

Figure 11:
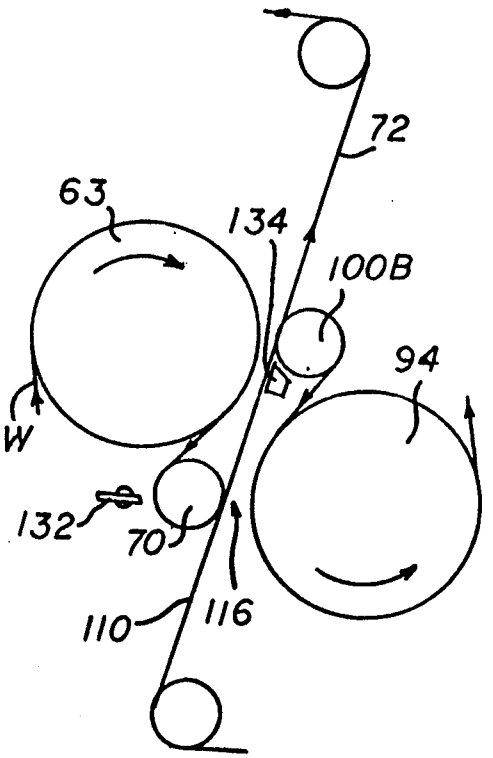
FIG. 11 is a side elevational view of another embodiment of the present invention showing a transfer box.

In a further embodiment of the present invention as shown in FIG. 11, the transfer mechanism includes a transfer box 134 adjacent to a turning roll 100B which may be grooved. The transfer box 134 may be a vacuum box or a blow box having a Coanda effect nozzle for transferring the web so that it follows roll 100B.

In operation of the apparatus, the web is transferred from the press section to a first dryer section of the apparatus. Drying of the first side of the web is initiated during passage of the web through the first dryer section 16. The web is transferred without open draw between the first dryer section 16 and a downstream second dryer section 22 with the web transfer being such that the web is reversed so that drying of the second side of the web is initiated during passage of the web through the second dryer section 22.

In operation of the apparatus the web is also transferred without open draw between subsequent dryer sections such that the first and second sides of the web are alternately exposed to the drying effect of the subsequent dryer section in sequence.

The present invention provides a drying section which is capable of operating at extremely high speeds as no open draws exist between the various sections thereof. Furthermore, the present invention enables threading of the drying section without the use of threading ropes.

What is claimed is:

1. A dryer apparatus for drying alternate sides of a web of paper, said apparatus comprising:

a single tier dryer section including:

a single tier of drying cylinders for drying one side of the web, said one side coming into direct surface contact with said drying cylinders;

a plurality of vacuum rolls, each roll of said plurality of vacuum rolls being lesser in diameter than, and in close proximity to, and disposed between and below adjacent drying cylinders of said single tier of drying cylinders, said plurality of vacuum rolls being connected to a source of partial vacuum;

a further single tier dryer section including:

a further single tier of drying cylinders for drying an opposite side of the web, said opposite side coming into direct surface contact with said drying cylinders of said further single tier;

a further plurality of vacuum rolls, each roll of said further plurality of vacuum rolls being lesser in diameter than, and in close proximity to, and disposed between and above adjacent drying cylinders of said further single tier of drying cylinders, said further plurality of vacuum rolls being connected to a source of partial vacuum; and means for transferring the web in an open draw between said single tier and said further single tier dryer sections.

2. A dryer apparatus as set forth in claim 1, wherein said plurality of vacuum rolls are arranged such that the web is restrained against machine and cross-machine directional shrinkage during movement of the web around each of said vacuum rolls;

and wherein said further plurality of vacuum rolls are arranged such that the web is restrained against cross-machine directional shrinkage during movement of the web round said further plurality of vacuum rolls.

3. A dryer apparatus for drying alternate sides of a web of paper, said apparatus comprising:

a single tier dryer section including:

a single tier of drying cylinders for drying one side of the web, said one side coming into direct surface contact with said drying cylinders;

a plurality of vacuum rolls, each roll of said plurality of vacuum rolls being lesser in diameter than, said in close proximity to, and disposed between and below adjacent drying cylinders of said single tier of drying cylinders, said plurality of vacuum rolls being connected to a source of partial vacuum;

a further single tier dryer section including:

a further single tier of drying cylinders for drying an opposite side of the web, said opposite side coming into direct surface contact with said drying cylinders of said further single tier;

a further plurality of vacuum rolls, each roll of said further plurality of vacuum rolls being lesser in diameter than, and in close proximity to, and disposed between and above adjacent drying cylinders of said further single tier of drying cylinders, said further plurality of vacuum rolls being connected to a source of partial vacuum; and means for transferring the web in an open draw between said single tier and said further single tier dryer sections.

* * * * *

UNITED STATES PATENT AND TRADEMARK OFFICE

CERTIFICATE OF CORRECTION

PATENT NO. : 5,249,372

DATED : October 5, 1993

INVENTOR(S) : Gregory L. Wedel

It is certified that error appears in the above-indentified patent and that said Letters Patent is hereby corrected as shown below:

| | |
|---|---|
| Column 1, Line 46: | Please delete "ha" and insert ---has--- in place thereof. |
| Column 5, Line 54: | Please delete "fiberstress" and insert ---fiber stress--- in place thereof. |
| Column 11, Line 49: | Please delete "ryer" and insert ---dryer--- in place thereof. |
| Column 14, Line 51: | Please delete "said" and insert ---and--- in place thereof. |
| Column 14, Line 52: | PLease delete "below" and insert ---above--- in place thereof. |
| Column 14, Line 64: | Please delete "above" and insert ---below--- in place thereof. |

Signed and Sealed this

Twelfth Day of April, 1994

*Attest:*

Bruce Lehman

BRUCE LEHMAN

*Attesting Officer*

*Commissioner of Patents and Trademarks*